US009497546B2

(12) United States Patent
Akino

(10) Patent No.: US 9,497,546 B2
(45) Date of Patent: Nov. 15, 2016

(54) STEREO BOUNDARY MICROPHONE AND STEREO BOUNDARY MICROPHONE ADAPTER

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/809,797

(22) Filed: Jul. 27, 2015

(65) Prior Publication Data

US 2016/0037259 A1 Feb. 4, 2016

(30) Foreign Application Priority Data

Jul. 31, 2014 (JP) ..... 2014-156535

(51) Int. Cl.
*H04R 5/027* (2006.01)
*H04R 1/32* (2006.01)

(52) U.S. Cl.
CPC ..... *H04R 5/027* (2013.01); *H04R 1/326* (2013.01)

(58) Field of Classification Search
CPC ..... H04R 5/027; H04R 1/326
See application file for complete search history.

(56) References Cited

U.S. PATENT DOCUMENTS

2013/0039523 A1* 2/2013 Van Dijk ..... H04R 1/342 381/356

FOREIGN PATENT DOCUMENTS

| | | | |
|---|---|---|---|
| JP | H08-65786 | A | 3/1996 |
| JP | 2002-300683 | A | 10/2002 |
| JP | 2013-527995 | A | 7/2013 |

* cited by examiner

*Primary Examiner* — Brenda Bernardi
(74) *Attorney, Agent, or Firm* — Manabu Kanesaka

(57) ABSTRACT

The stereo boundary microphone includes a boundary plate, a case body attached to the boundary plate and having an elongate shape including left and right grooves provided in opposite sides and extending along the longitudinal direction, first and second side walls covering the grooves included in the case body by predetermined distances to form left and right acoustic passages, and first and second microphones contained in tail end portions of the acoustic passages so as directional axes of the first and second microphones to be parallel. An opening communicating with the tail end portion of the case body is provided and services as a rear acoustic terminal to be used by both the first and second microphones. Front ends of the acoustic passages formed by the side walls serve as left and right front acoustic terminals of the first and second microphones.

20 Claims, 9 Drawing Sheets

STEREO BOUNDARY MICROPHONE AND STEREO BOUNDARY MICROPHONE ADAPTER

RELATED APPLICATIONS

The present application is based on, and claims priority from, Japanese Application No. JP2014-156535 filed Jul. 31, 2014, the disclosure of which is hereby incorporated by reference herein in its entirety.

BACKGROUND OF THE INVENTION

Field of the Invention

The present invention relates to a stereo boundary microphone using, for example, two unidirectional microphones and a stereo boundary microphone adapter.

Description of the Related Art

A boundary microphone (on-surface sound pickup microphone) is usually used in a conference room or a broadcast studio.

When used in a conference room, the boundary microphone is placed on a table. When used in a broadcast studio, the boundary microphone is placed on a table or on a floor so as not to be apparent (not to be shot by a television camera).

As disclosed, for example, in JP H8-65786 A and JP 2013-527995 W, the boundary microphone is configured with a boundary plate and a microphone held on the boundary plate.

The microphone is placed close to the boundary plate. The direct sound and the reflected sound from the boundary plate entering the microphone have almost no time-gap (phase difference). Accordingly a clear high acoustic signal can be collected by the boundary microphone.

For stereo sound collection technique using two unidirectional microphones, A-B technique and X-Y technique are known. In the A-B technique, microphones are positioned with a relatively large distance therebetween to create stereo effect by a time-gap. In the X-Y technique, microphones are positioned so as their sound collection axes intersect by a certain angle (for example, 90 to 120 degrees) to create stereo effect by the difference in level of sounds entering the two microphones.

A stereo boundary microphone employing stereo sound collection technique, such as the A-B technique and the X-Y technique, is disclosed in JP 2002-300683.

FIG. 13 illustrates an example stereo boundary microphone employing the X-Y technique.

As illustrated in FIG. 13, two unidirectional microphones 5L and 5R are held on a boundary plate 11 having a rectangular shape. In this example, the two unidirectional microphones 5L and 5R are positioned so as sound collection axes LX and RX of the microphones 5L and 5R, respectively, to be parallel with the top face of the boundary plate 1 and intersect with each other at 120 degrees.

In this configuration, difference in level of sounds entering the two microphones 5L and 5R is produced, and this difference creates stereo effect. With the effect of the boundary plate 11 positioned to be parallel with the sound collection axes LX and RX, the microphones 5L and 5R receive clear acoustic signals for left and right channels.

The stereo boundary microphone illustrated in FIG. 13 has left and right unidirectional microphones 5L and 5R positioned so as to face each other at a predetermined angle above the boundary plate 11. In such a configuration, a large positioning region (area) is necessary for two microphones.

Moreover, audio output cords 6L and 6R of microphones are routed out through both sides of the boundary plate 11. For this reason, conventional boundary microphones disadvantageously have messy and unfavorable external appearance and difficulty in downsizing.

SUMMARY OF THE INVENTION

The present invention is made in view of the aforementioned problem of conventional stereo boundary microphones. The object of the present invention is to provide a stereo boundary microphone that has a compact and neat arrangement on a boundary plate, capability to adjust each microphone to have narrow directional property, and excellent external appearance, and to provide a stereo boundary microphone adapter that provides similar effect.

To solve the aforementioned problem, a stereo boundary microphone according to the embodiment includes a boundary plate, a case body that has an elongate shape, includes a partition wall extending along a longitudinal direction in a middle portion of the case body and left and right grooves provided in opposite sides of the partition wall, and is attached to the boundary plate, the partition wall being used as a bottom of both the left and right grooves, first and second microphones contained in tail end portions of the left and right grooves so as directional axes of the first and second microphones to be parallel with each other. The case body is provided with acoustic passages that guide acoustic waves through the left and right grooves, and an opening communicating from the partition wall to the tail end portions, the opening serving as a rear acoustic hole to be used by both the first and second microphones.

In this configuration, acoustic resistance parts are attached to the left and right grooves formed in the case body as first and second side walls. The first and second side walls cover the left and right grooves from the tail end portions by predetermined distances to determine the lengths of the acoustic passages.

By selecting the lengths of the first and second side walls from the tail end portions of the left and right grooves, the lengths of the acoustic passages can be determined as desired.

Preferably, cable insertion grooves that allow acoustic signal cables of the first and second microphones to be routed out are provided in the tail end portions of the left and right grooves. The cable insertion grooves are located so that the opening communicating with the tail end portions is in the middle between the cable insertion grooves.

More preferably, the lengths of the acoustic passages formed in the left and right grooves are the same.

To solve the aforementioned problem, a stereo boundary microphone adapter includes a boundary plate, and a case body that has an elongate shape, includes a partition wall extending along a longitudinal direction in a middle portion of the case body and left and right grooves provided in opposite sides of the partition wall, and is attached to the boundary plate, the partition wall being used as a bottom of both the left and right grooves. The left and right grooves are provided in tail end portions thereof with microphone containers that can contain first and second microphones so as directional axes of the first and second microphones to be parallel with each other. The case body is provided with acoustic passages that guide acoustic waves through the left and right grooves, and an opening communicating from the partition wall to the tail end portions, the opening serving as a rear acoustic hole to be used by both the first and second microphones.

Preferably in this configuration, acoustic resistance parts are attached to the left and right grooves included in the case body as first and a second side walls. The first and second side walls cover the left and right grooves from the tail end portions of the left and right grooves by predetermined distances to determine the lengths of the acoustic passages.

Preferably, for the stereo boundary microphone adapter, two cable insertion grooves are provided in the tail end portions of the case body. The cable insertion grooves communicate with the first and second grooves, respectively, to allow acoustic signal cables of the first and second microphones contained in the containers to be routed out. The cable insertion grooves are located so that the opening communicating with the tail end portions is in the middle between the cable insertion grooves.

The stereo boundary microphone and the stereo boundary microphone adapter configured as described above have the acoustic passages formed by the left and right grooves included in the elongate case body. By covering predetermined lengths of the left and right grooves with side walls, such as acoustic resistance parts, the left and right acoustic passages provide effect similar to that of an acoustic tube of a microphone having narrow directional property.

The first and second microphones are contained in the tail end portions of the left and right acoustic passages. A rear acoustic hole is provided in the tail end portion of the case body to be used by both the first and second microphones. The rear acoustic terminal of the first microphone and the rear acoustic terminal of the second microphone are the same. Front ends of the acoustic passages facing the outside of the case body serve as the front acoustic terminal of the first microphone and the front acoustic terminal of the second microphone, respectively.

With this configuration, the first and second microphones work by sound pressure gradients created between front acoustic terminals, respectively, and the same rear acoustic terminal to produce directional property in which directional axes are distributed in the left and right sides.

With the elongate case body attached to the boundary plate, the stereo boundary microphone can collect clear acoustic sound in left and right channels by the effect of the boundary plate.

The first and second microphones are contained side by side in the elongate case body with a compact arrangement on the boundary plate. The acoustic signal cables of microphones can also be routed along the longitudinal direction of the case body in a neat arrangement. Consequently, a stereo boundary microphone that allows easy routing of cables and has excellent external appearance can be provided.

DESCRIPTION OF THE PREFERRED EMBODIMENTS

Figure 1:
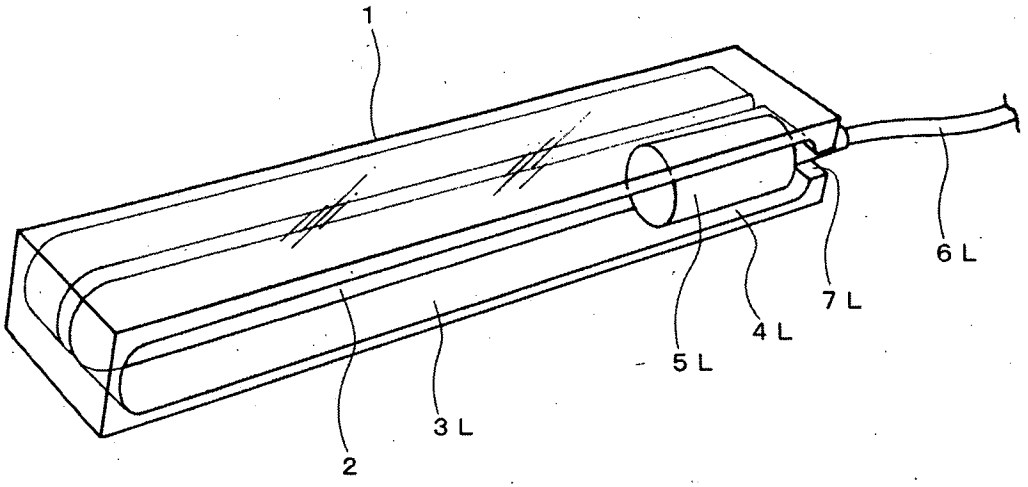
FIG. 1 is a perspective view illustrating a case body and a microphone that constitute a stereo boundary microphone.
Figure 2:
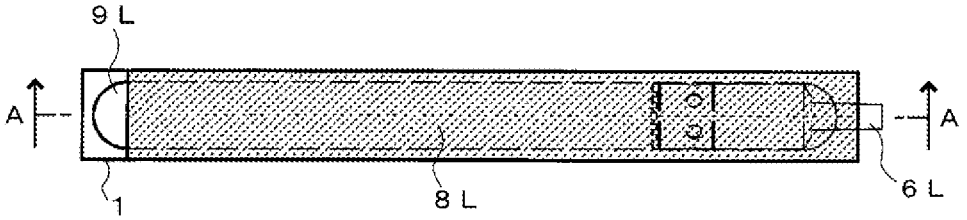
FIG. 2 is a side view illustrating the case body containing microphones and acoustic resistance parts attached to the case body.

A stereo boundary microphone and a stereo boundary microphone adapter according to an embodiment of the present invention will be described referring to the drawings.

FIGS. 1 to 5 illustrate a case body constituting a part of a stereo boundary microphone. The case body 1 illustrated in the embodiment is formed of, for example, an acrylic resin in an elongate shape. The case body 1 includes in the middle a partition wall 2 extending along the longitudinal direction of the case body 1.

Left and right grooves 3L and 3R are provided on the opposite sides of the partition wall 2. The partition wall 2 in the middle is used as a bottom of both the grooves 3L and 3R.

Tail end portions of the left and right grooves 3L and 3R provided in the case body 1 are configured as microphone containers 4L and 4R. The microphone containers 4L and 4R contain first and second microphones, for example, unidirectional capacitor microphones 5L and 5R. In this case, as illustrated in FIG. 3, the microphones 5L and 5R are positioned so as directional axes of microphones extend parallel with each other toward the front end of the case body 1.

Cable insertion grooves 7L and 7R communicating with the first and second grooves, respectively, are provided in the tail end portion of the case body 1. When the microphones 5L and 5R are assembled in the case body 1, acoustic signal cables 6L and 6R of the microphones 5L and 5R are routed out through the cable insertion grooves 7L and 7R provided in the case body 1.

In this configuration, the cables 6L and 6R can be routed out along the longitudinal direction of the case body 1.

Figure 3:
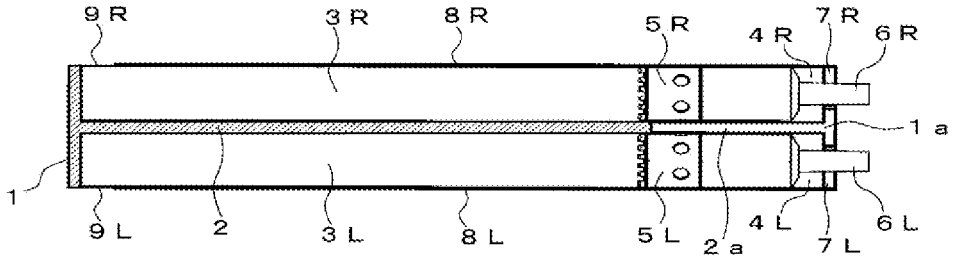
FIG. 3 is a sectional view taken in the direction indicated by the arrow along the line A-A in FIG. 2.
Figure 4:
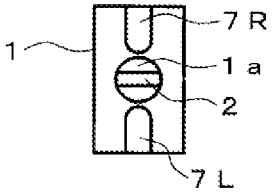
FIG. 4 is an end view of a tail end portion of the case body viewed from the right hand side in FIG. 3.
Figure 5:
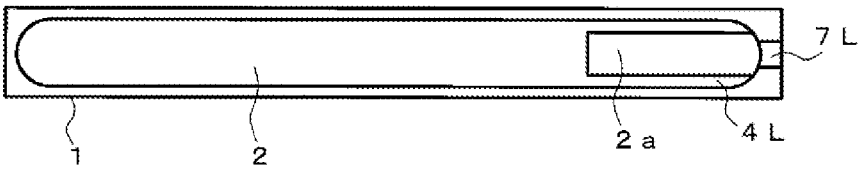
FIG. 5 is a side view of the case body alone.

As illustrated in FIGS. 3 to 5, an opening 1*a* is provided in the tail end portion of the case body 1 to communicate from the partition wall 2 to the tail end portion. That is, the opening 1*a* communicates with a cut-out region 2*a* of the partition wall 2 as illustrated in FIG. 5. The cut-out region 2*a* of the partition wall 2 and the opening 1*a*, communicating with each other, serve as a rear acoustic hole to be used by both the first and second microphones 5L and 5R. With the rear acoustic hole 1 formed in the central region of the tail end portion of the case body 1, the rear acoustic terminal of the first microphone 5L and the rear acoustic terminal of the second microphone 5R are formed in the same place.

As illustrated in FIG. 4, the case body 1 is provided with the cable insertion grooves 7L and 7R located so that the case opening (the rear acoustic hole to be used by both the microphones) la provided in the tail end portion is in the middle between the cable insertion grooves 7L and 7R.

The grooves 3L and 3R are provided on both sides of the case body 1 to extend from the tail end portion of the case body 1 by a predetermined distance. Each of the grooves 3L and 3R serves as an acoustic passage that guides acoustic waves to the microphone unit. When the microphones 5L and 5R are assembled in the microphone containers 4L and 4R, the partition wall 2 and walls forming the grooves 3L and 3R cover three sides of each of the microphones 5L and 5R. Accordingly, the front acoustic terminals of the microphones 5L and 5R are formed at opened portions, and thus the directional axes incline toward the opened portions. That is, the directional axes of the microphones 5L and 5R assembled in both sides of the case body 1 incline. The directional axis of the microphone 5L inclines to the left and the directional axis of the microphone 5R inclines to the right. This combination constitutes a stereo microphone having directional property similar to that of the stereo microphone employing the A-B technique.

By forming a side wall on the opened portion of each of the grooves 3L and 3R, the grooves 3L and 3R function as acoustic tubes. The grooves 3L and 3R may be covered by the side walls (first and second side walls 8L and 8R). Preferably, the first and second side walls 8L and 8R are acoustic resistance parts.

When the grooves 3L and 3R are covered by the side walls 8L and 8R, which are acoustic resistance parts, the acoustic passages formed by the grooves 3L and 3R function as acoustic tubes. In this configuration, the microphones 5L and 5R are contained in the left and right acoustic tubes, respectively. Openings 9L and 9R of the acoustic tubes are formed by front ends of the side walls 8L and 8R that cover the grooves 3L and 3R, respectively. The openings 9L and 9R of the acoustic tubes are provided on the case body 1 to face outside. The acoustic passages covered by the side walls 8L and 8R, which are acoustic resistance parts, are configured in a manner similar to an acoustic tube for providing narrow directional property. With acoustic tubes having the side walls 8L and 8R composed of acoustic resistance parts, a microphone having narrow directional property that is not disturbed by noises, such as winds, can be provided.

Figure 6A:
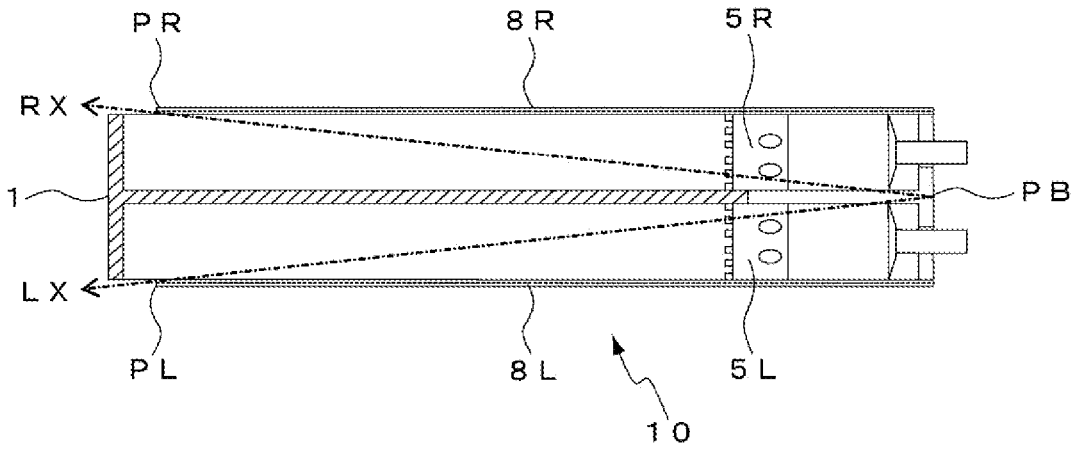
FIG. 6A is a schematic view illustrating relationship between the coverage of grooves by the acoustic resistance parts and sound collection axes.
Figure 6B:
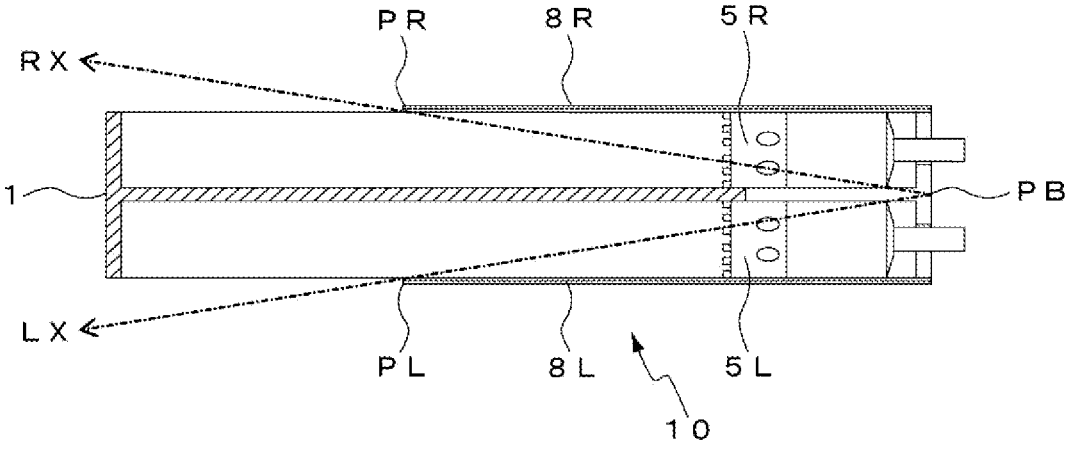
FIG. 6B is a schematic view illustrating the same with varied sound collection axes.

FIGS. 6A and 6B illustrate the effect of the stereo microphone unit 10 configured with the case body 1, the left and right microphones 5L and 5R, and the side walls 8L and 8R, in particular, the relationship between the length and the directional axes of the side walls 8L and 8R composed of acoustic resistance parts.

The left and right microphones 5L and 5R have the same unidirectional property. This means that the microphones 5L and 5R each have a front acoustic terminal and a rear acoustic terminal.

In contrast, the stereo microphone unit 10 configured with the left and right microphones 5L and 5R assemble in the case body 1 as illustrated in FIGS. 6A and 6B has a right front acoustic terminal PR and a left front acoustic terminal PL at front ends of the side walls 8L and 8R, respectively.

The opening 1*a* provided in the tail end portion of the case body 1 serves as a rear acoustic terminal PB used by both the left and right microphones 5L and 5R to provide function of a stereo microphone.

As illustrated in FIG. 6A, a left sound collection axis (left directional axis) LX is provided by a line connecting the rear acoustic terminal PB and the left front acoustic terminal PL, and a right sound collection axis (right directional axis) RX is provided by a line connecting the rear acoustic terminal PB and the right front acoustic terminal PR.

FIG. 6B illustrates a configuration where the side walls 8L and 8R composed of the acoustic resistance parts have short lengths toward the forward direction. In this configuration, the left and right front acoustic terminals PL and PR are located in longitudinally retreated positions along the case body 1. Thus the angle between each of the left and right sound collection axes (left and right directional axes) LX and RX increases as illustrated in FIG. 6B.

With this configuration, the angle between the sound collection axis and the longitudinal direction of the case body 1 (directional property of a stereo microphone) can be adjusted easily where the angle of 0 degree is the longitudinal direction of the case body 1.

Moreover, the acoustic resistance can be changed and adjusted by suitably selecting the length of the acoustic tubes formed by the side walls 8L and 8R and the material of the side walls 8L and 8R. In this manner, a stereo microphone unit having narrow directional property can be provided.

Figure 7:
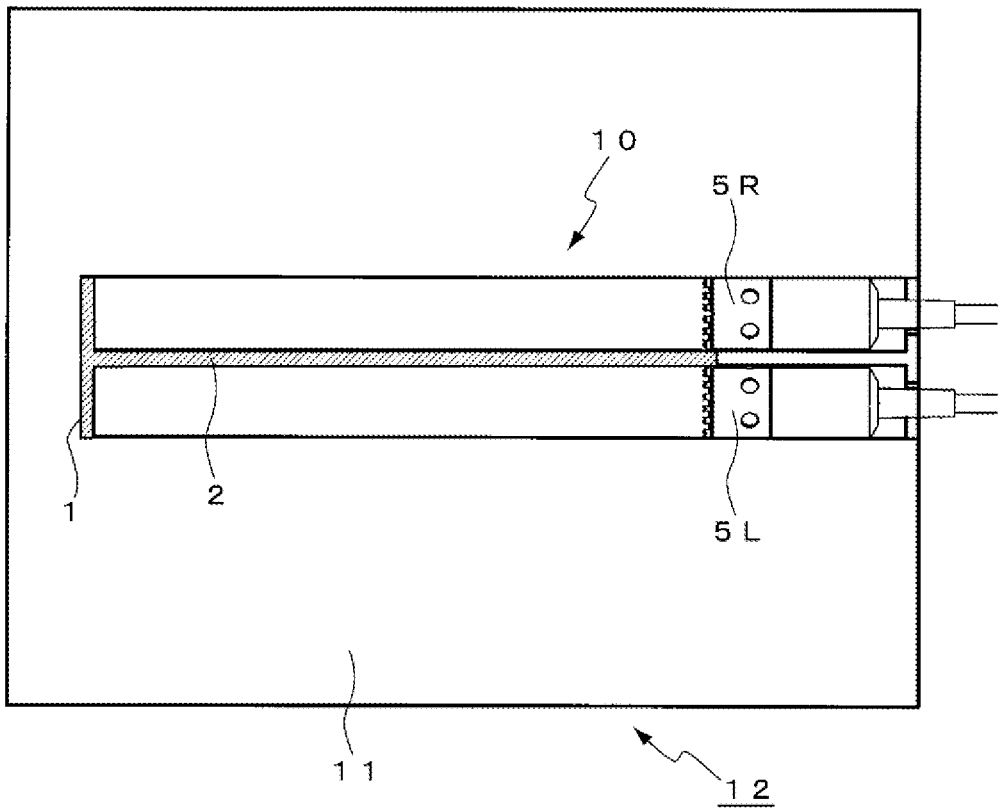
FIG. 7 is a plan view of a stereo boundary microphone according to the embodiment.
Figure 8:
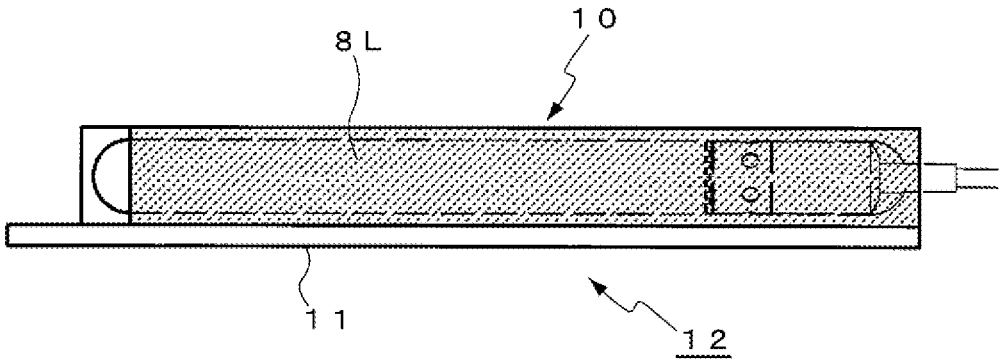
FIG. 8 is a side view of the same.

FIGS. 7 and 8 illustrate the stereo microphone unit 10 attached to the boundary plate 11 to constitute a stereo boundary microphone 12. A rectangular boundary plate 11 is used in the configuration illustrated in FIGS. 7 and 8. In the stereo microphone unit 10 of this configuration, the case body 1 is positioned in the central region on the boundary plate 11 so as to longitudinally extend along the long side of the boundary plate 11.

In the stereo boundary microphone 12 of this configuration, the left and right front acoustic terminals PL and PR are formed on the left and right sides of the case body 1 to be in close proximity to the boundary plate 11 on right and left sides of the case body 1. Accordingly the difference in distance between direct waves and reflected waves from the boundary plate 11 is minimized. Such a configuration contributes to further flattening frequency response property of the stereo boundary microphone 12.

For this stereo boundary microphone, lengths of the side walls 8L and 8R extending from tail end portions of the case body 1 to cover the left and right grooves 3L and 3R (i.e., lengths of left and right acoustic tubes) are preferably the same. This takes the balance between the directional frequency responses of left and right channels of the stereo boundary microphone 12.

FIGS. 9 to 12 illustrate directional frequency response properties and polar patterns obtained by the stereo boundary microphone 12.

Figure 9A:
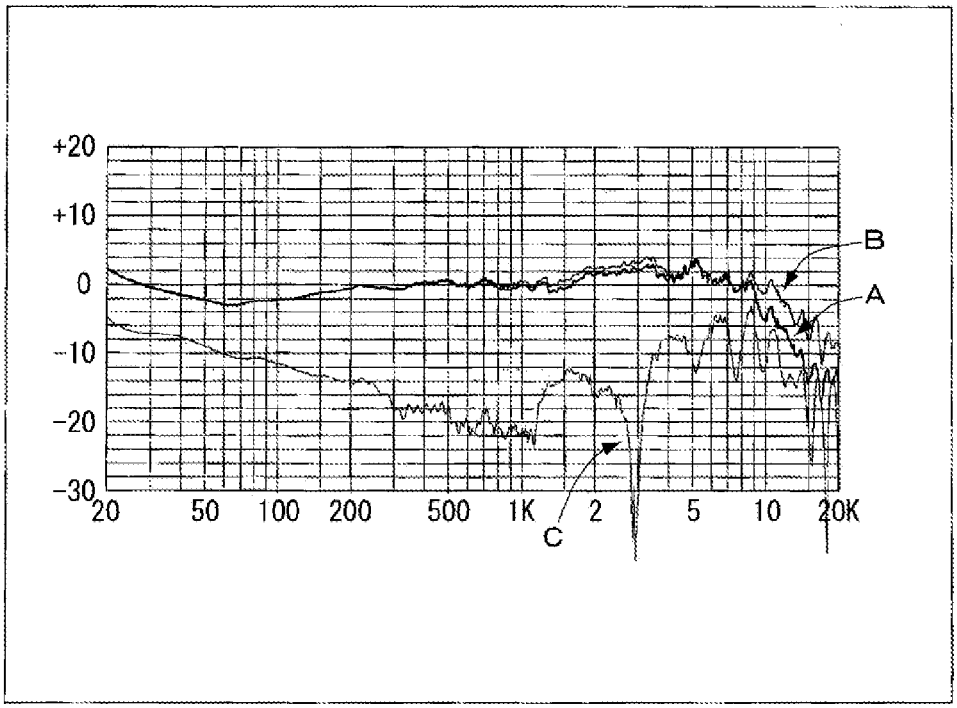
FIG. 9A illustrates measured directional frequency response property of a left channel of the stereo boundary microphone according to the embodiment.
Figure 9B:
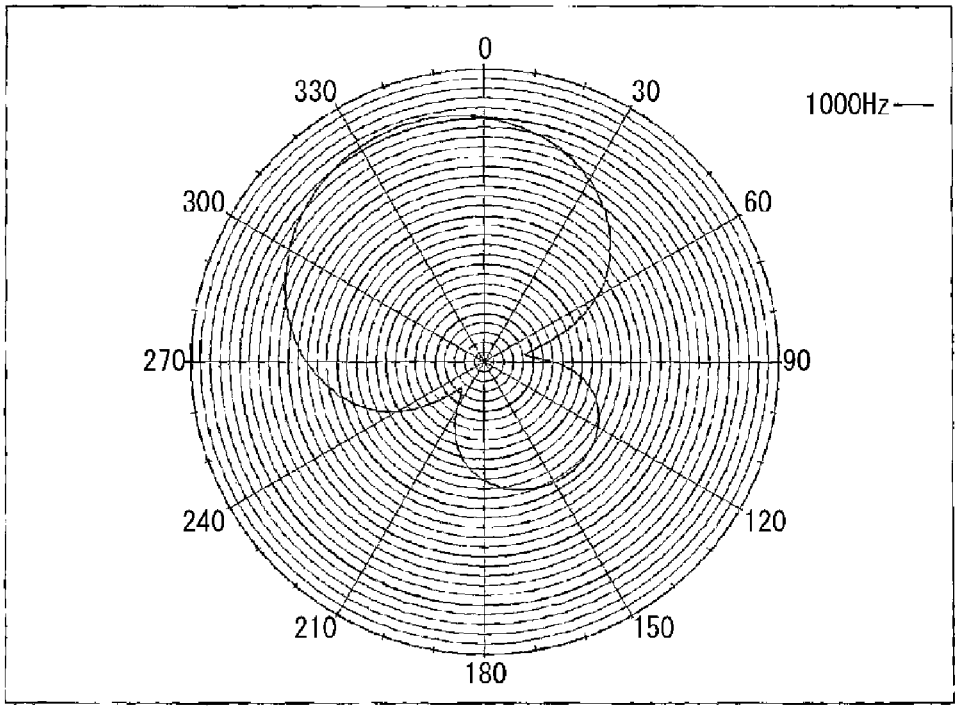
FIG. 9B illustrates a measured polar pattern of the same.

FIG. 9A illustrates directional frequency responses of the left channel where the angle of 0 degree is the longitudinal direction of the case body 1. The directional frequency response indicated by reference sign A is of 0 degree, reference sign B is of 340 degrees, and reference sign C is of 220 degrees. FIG. 9B is a polar pattern of the same.

Figure 10A:
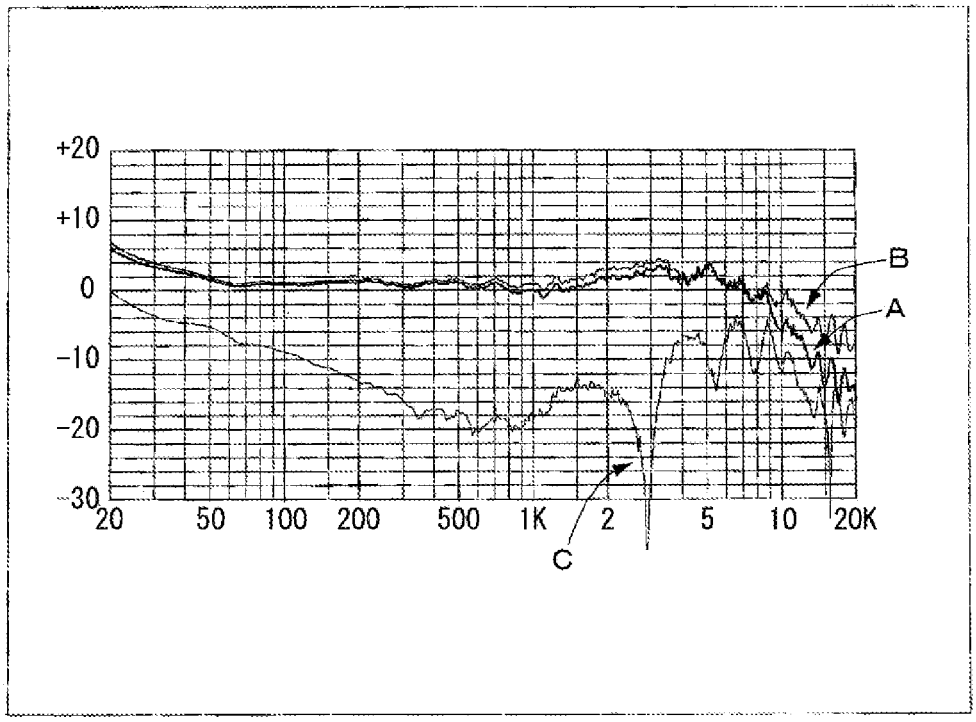
FIG. 10A illustrates measured directional frequency response property of a right channel of the stereo boundary microphone according to the embodiment.
Figure 10B:
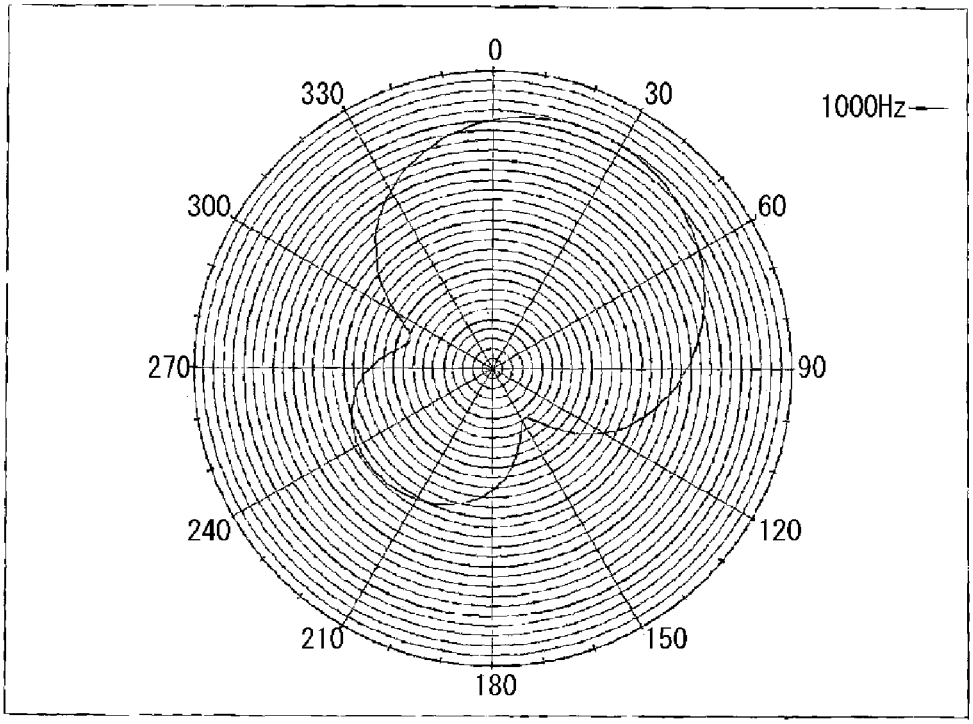
FIG. 10B illustrates a measured polar pattern of the same.

FIG. 10A illustrates directional frequency responses of the right channel. The directional frequency response indicated by reference sign A is of 0 degree, reference sign B is of 20 degrees, and reference sign C is of 140 degrees. FIG. 10B is a polar pattern of the same.

As can be understood from the properties illustrated in FIGS. 9A to 10B, the left channel has suppressed sound collection property for acoustic waves entering from 220 degrees direction, and the right channel has suppressed sound collection property for acoustic waves entering from 140 degrees direction.

Figure 11A:
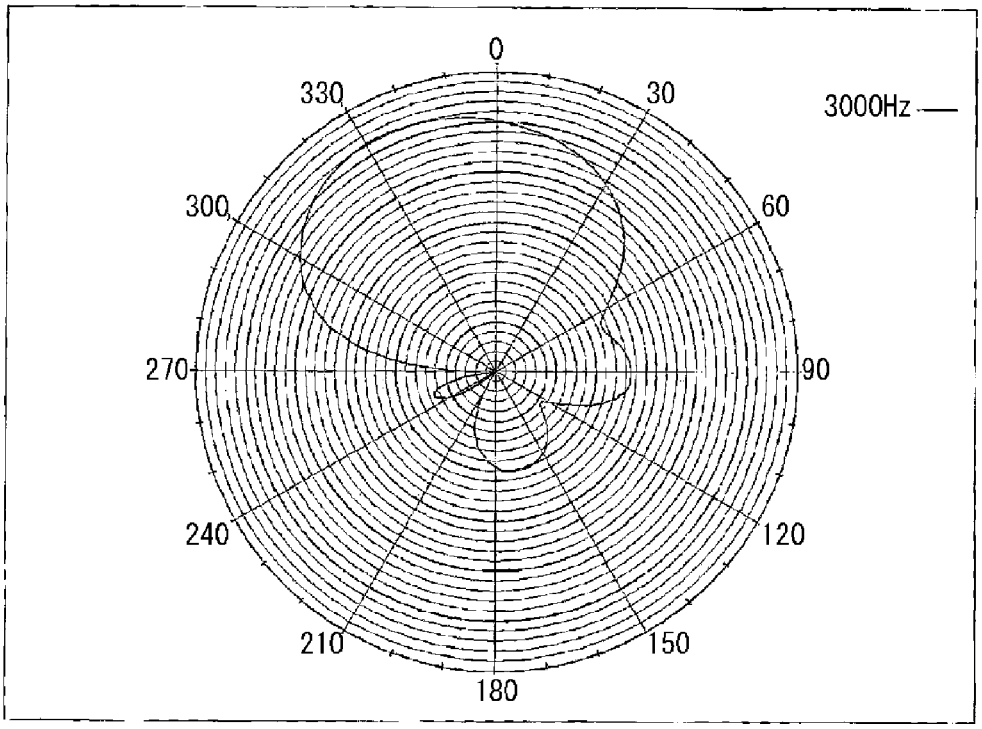
FIG. 11A illustrates a measured polar pattern of the left channel adjusted to have narrow directional property by adjusting an acoustic tube.
Figure 11B:
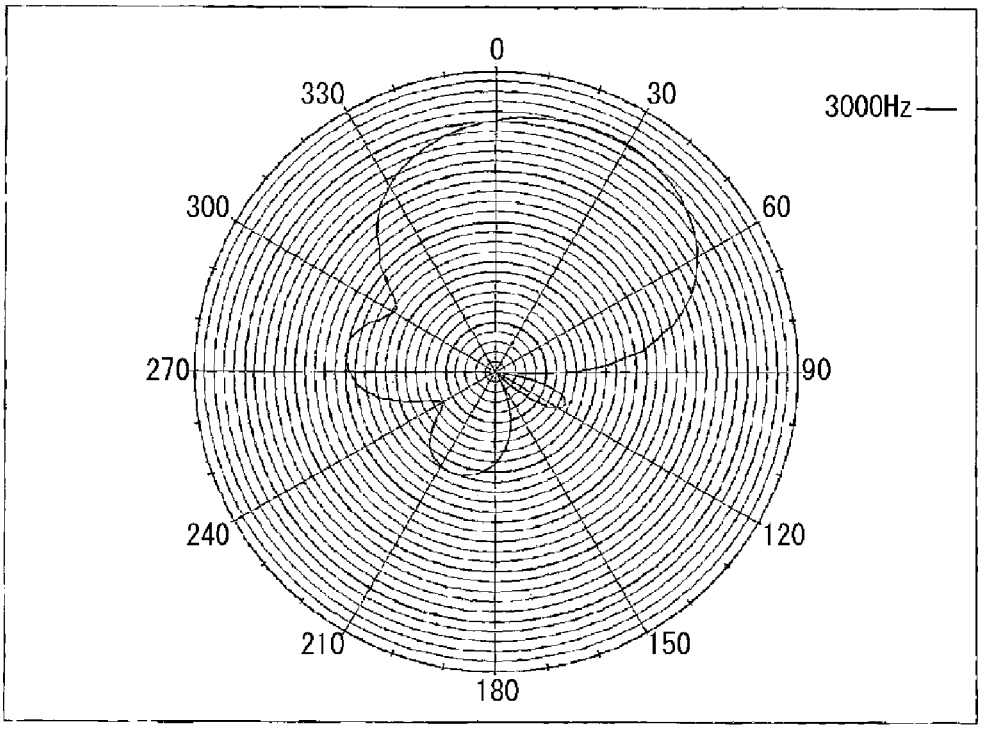
FIG. 11B illustrates a measured polar pattern of the right channel adjusted by the same way.

FIGS. 11A and 11B illustrate the property of example configuration controlled to have narrow directional property by adjustment made by selecting the material of the left and right side walls 8L and 8R and the lengths of the acoustic tubes. FIG. 11A illustrates a polar pattern of the left channel, and FIG. 11B illustrates a polar pattern of the right channel.

Figure 12A:
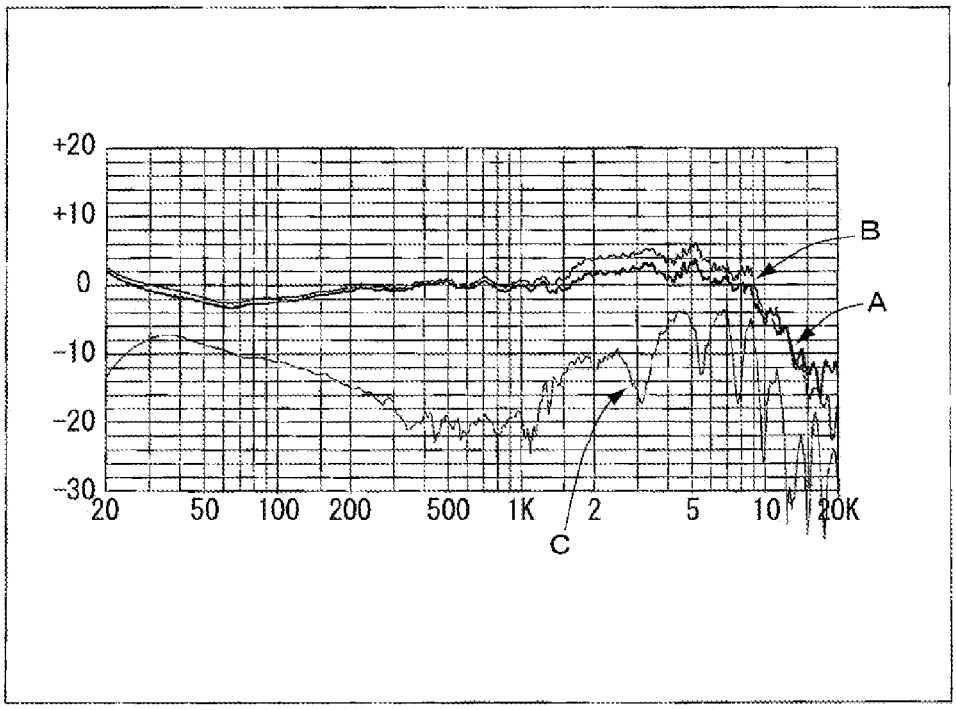
FIG. 12A illustrates measured directional frequency response property on a plane perpendicular to the boundary plate.
Figure 12B:
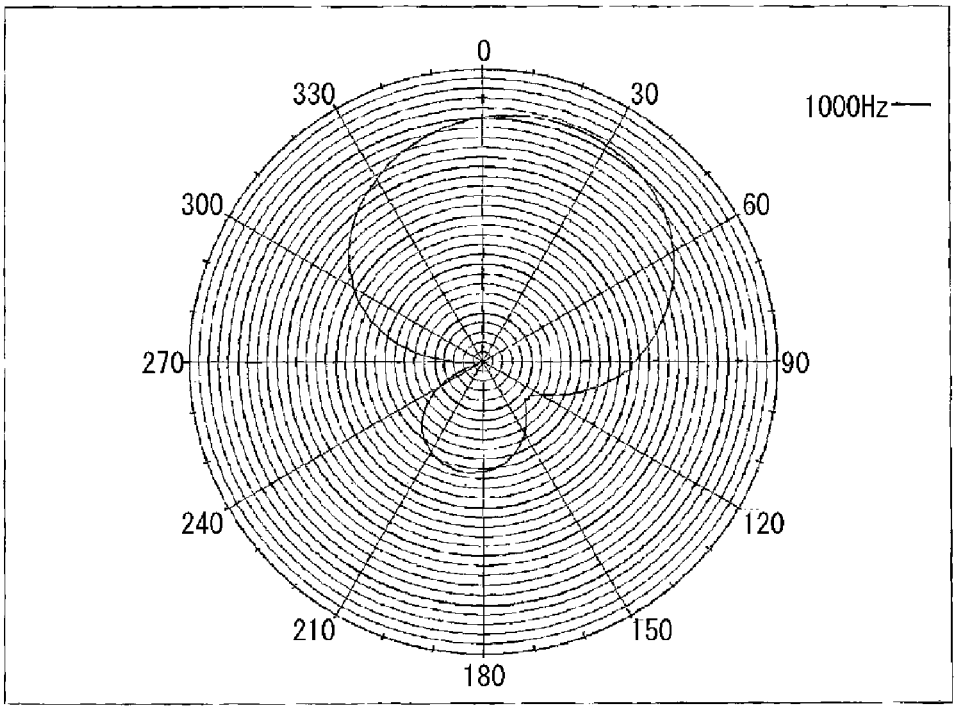
FIG. 12B illustrates a measured polar pattern of the same.
Figure 13:
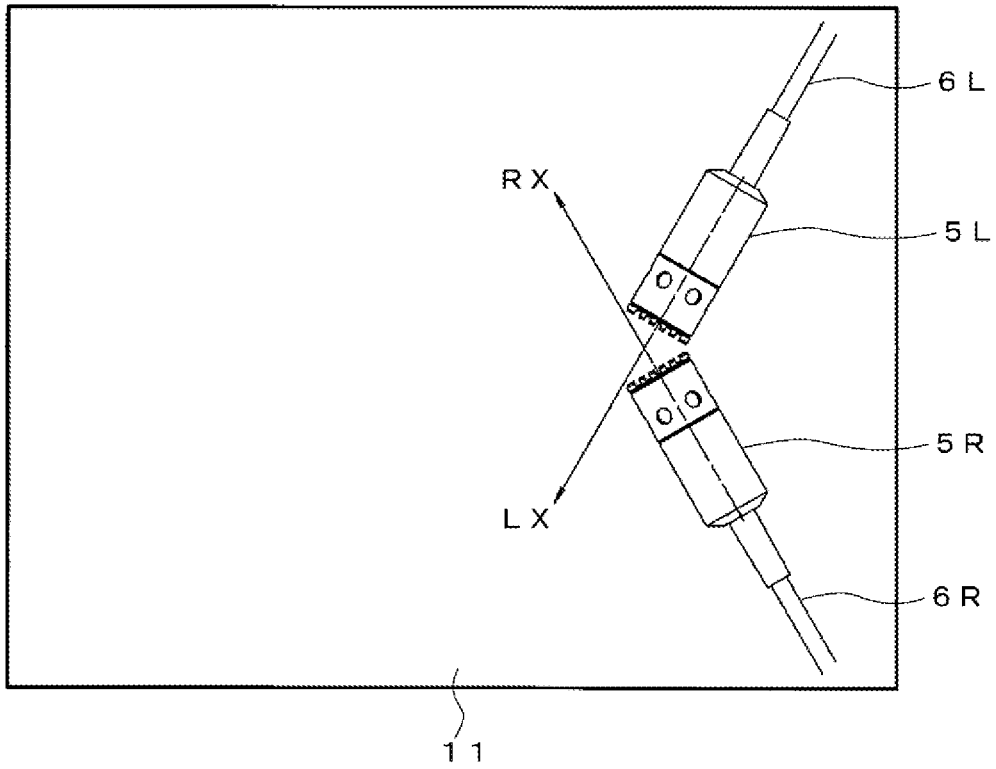
Fig. 13 Prior Art
FIG. 13 is a plan view of a conventional stereo boundary microphone.

FIG. 12A illustrates a directional frequency response property of the left channel on a plane perpendicular to the boundary plate 11. The directional frequency response indicated by reference sign A is of 0 degree, reference sign B is of 20 degrees, and reference sign C is of 130 degrees. FIG. 12B is a polar pattern of the same.

As described above, the stereo boundary microphone according to the embodiment is provided with microphones contained side by side in the elongate case body to collect left and right acoustic signals. Accordingly unidirectional microphones need not be arranged to have angles between each other as configured in conventional stereo microphones. The microphones and their acoustic signal cables can be fixed on the boundary plate in a compact and neat arrangement, which creates the effect of the invention as described above.

The stereo boundary microphone without left and right microphones, that is, the case body 1 can be provided as a stereo boundary microphone adapter. In this case, a user can prepare left and right microphones to configure a stereo boundary microphone providing a similar effect without difficulty.

What is claimed is:

1. A stereo boundary microphone comprising:

a boundary plate;

a case body that has an elongate shape, includes a partition wall extending along a longitudinal direction in a middle portion of the case body and left and right grooves provided in opposite sides of the partition wall, and is attached to the boundary plate, the partition wall being used as a bottom of both the left and right grooves; and first and second microphones contained in tail end portions of the left and right grooves so as directional axes of the first and second microphones to be parallel with each other, wherein the case body is provided with acoustic passages that guide acoustic waves through the left and right grooves, and an opening communicating from the partition wall to the tail end portions, the opening serving as a rear acoustic hole to be used by both the first and second microphones.

2. The stereo boundary microphone according to claim 1, wherein first and second side walls are attached to the left and right grooves included in the case body, and the first and second side walls cover the left and right grooves from the tail end portions by predetermined distances.

3. The stereo boundary microphone according to claim 2, wherein lengths of the acoustic passages are set by selecting lengths of the first and second side walls extending from the tail end portions of the left and right grooves.

4. The stereo boundary microphone according to claim 2, wherein the first and second side walls are composed of acoustic resistance parts.

5. The stereo boundary microphone according to claim 3, wherein the first and second side walls are composed of acoustic resistance parts.

6. The stereo boundary microphone according to claim 1, wherein cable insertion grooves that allow acoustic signal cables of the first and second microphones to be routed out are provided in the tail end portions of the left and right grooves, the cable insertion grooves being provided in opposite sides of the opening communicating with the tail end portions.

7. The stereo boundary microphone according to claim 2, wherein cable insertion grooves that allow acoustic signal cables of the first and second microphones to be routed out are provided in the tail end portions of the left and right grooves, the cable insertion grooves being provided in opposite sides of the opening communicating with the tail end portions.

8. The stereo boundary microphone according to claim 3, wherein cable insertion grooves that allow acoustic signal cables of the first and second microphones to be routed out are provided in the tail end portions of the left and right grooves, the cable insertion grooves being provided in opposite sides of the opening communicating with the tail end portions.

9. The stereo boundary microphone according to claim 1, wherein the acoustic passages formed by the left and right grooves have same length.

10. The stereo boundary microphone according to claim 2, wherein the acoustic passages formed by the left and right grooves have same length.

11. The stereo boundary microphone according to claim 3, wherein the acoustic passages formed by the left and right grooves have same length.

12. The stereo boundary microphone according to claim 4, wherein the acoustic passages formed by the left and right grooves have same length.

13. A stereo boundary microphone adapter comprising:

a boundary plate; and a case body that has an elongate shape, includes a partition wall extending along a longitudinal direction in a middle portion of the case body and left and right grooves provided in opposite sides of the partition wall, and is attached to the boundary plate, the partition wall being used as a bottom of both the left and right grooves, wherein the left and right grooves are provided in tail end portions thereof with microphone containers that can contain first and second microphones so as directional axes of the first and second microphones to be parallel with each other, the case body is provided with acoustic passages that guide acoustic waves through the left and right grooves, and an opening communicating from the partition wall to the tail end portions, the opening serving as a rear acoustic hole to be used by both the first and second microphones.

14. The stereo boundary microphone adapter according to claim 13, wherein first and second side walls are attached to the left and right grooves included in the case body, and the first and second side walls cover the left and right grooves from the tail end portions by predetermined distances.

15. The stereo boundary microphone adapter according to claim 14, wherein lengths of the acoustic passages are set by selecting lengths of the first and second side walls extending from the tail end portions of the left and right grooves.

16. The stereo boundary microphone adapter according to claim 14, wherein the first and second side walls are composed of acoustic resistance parts.

17. The stereo boundary microphone adapter according to claim 15, wherein the first and second side walls are composed of acoustic resistance parts.

18. The stereo boundary microphone adapter according to claim 13, wherein cable insertion grooves that allow acoustic signal cables of the first and second microphones to be routed out are provided in the tail end portions of the left and right grooves, the cable insertion grooves being provided in opposite sides of the opening communicating with the tail end portions.

19. The stereo boundary microphone adapter according to claim 14, wherein cable insertion grooves that allow acoustic signal cables of the first and second microphones to be routed out are provided in the tail end portions of the left and right grooves, the cable insertion grooves being provided in opposite sides of the opening communicating with the tail end portions.

20. The stereo boundary microphone adapter according to claim 15, wherein cable insertion grooves that allow acoustic signal cables of the first and second microphones to be routed out are provided in the tail end portions of the left and right grooves, the cable insertion grooves being provided in opposite sides of the opening communicating with the tail end portions.

* * * * *